US010364692B2

(12) United States Patent
Eisenmenger et al.

(10) Patent No.: US 10,364,692 B2
(45) Date of Patent: Jul. 30, 2019

(54) EXPANSION MACHINE HAVING A SHAFT SEALING RING AND A VALVE

(71) Applicant: Robert Bosch GmbH, Stuttgart (DE)

(72) Inventors: Nadja Eisenmenger, Stuttgart (DE); Steffen Buhl, Sachsenheim-Spielberg (DE)

(73) Assignee: Robert Bosch GmbH, Stuttgart (DE)

( * ) Notice: Subject to any disclaimer, the term of this patent is extended or adjusted under 35 U.S.C. 154(b) by 2 days.

(21) Appl. No.: 15/539,102

(22) PCT Filed: Oct. 22, 2015

(86) PCT No.: PCT/EP2015/074518

§ 371 (c)(1),
(2) Date: Jun. 22, 2017

(87) PCT Pub. No.: WO2016/102100

PCT Pub. Date: Jun. 30, 2016

(65) Prior Publication Data

US 2018/0171811 A1 Jun. 21, 2018

(30) Foreign Application Priority Data

Dec. 23, 2014 (DE) ..... 10 2014 226 954

(51) Int. Cl.
*F01D 11/00* (2006.01)
*F01D 5/04* (2006.01)
*F01D 11/02* (2006.01)

(52) U.S. Cl.
CPC ..... *F01D 11/003* (2013.01); *F01D 5/046* (2013.01); *F01D 11/001* (2013.01); *F01D 11/02* (2013.01)

(58) Field of Classification Search
CPC .... F16J 15/322; F16J 15/3224; F01D 11/003; F01D 11/001; F01D 11/02; F01D 5/046
See application file for complete search history.

(56) References Cited

U.S. PATENT DOCUMENTS 2,175,868 A 10/1939 Bentley
4,630,642 A 12/1986 Detweiler
(Continued)

FOREIGN PATENT DOCUMENTS

CH 329142 4/1958
CN 103746493 4/2014
(Continued)

OTHER PUBLICATIONS

International Search Report for Application No. PCT/EP2015/074518 dated Jan. 14, 2016 (English Translation, 2 pages).

*Primary Examiner* — Gilbert Y Lee
(74) *Attorney, Agent, or Firm* — Michael Best & Friedrich LLP

(57) ABSTRACT

The invention relates to an expansion machine (20), comprising an output shaft (24) and a shaft sealing ring (25) that interacts with the output shaft. The expansion machine (20) has an inflow region (21) and an outflow region (22). During operation, a working medium flows through the expansion machine (20), wherein compressed working medium flows into the inflow region (21) and expanded working medium flows out of the outflow region (22). The shaft sealing ring (25) separates a valve space (11) filled with working medium from a surrounding space (40). A valve (10) is arranged in the expansion machine (20). The pressure in the valve space (11) can be controlled by means of the valve (10).

20 Claims, 4 Drawing Sheets

(56) References Cited

U.S. PATENT DOCUMENTS

| | | | | |
|---|---|---|---|---|
| 4,765,227 | A * | 8/1988 | Balazs | B21D 24/02 137/493.2 |
| 8,622,690 | B1 | 1/2014 | Wall | |
| 2005/0156386 | A1* | 7/2005 | Ota | F16J 15/322 277/549 |

FOREIGN PATENT DOCUMENTS

| | | |
|---|---|---|
| CN | 203730202 U | 7/2014 |
| DE | 2253839 | 4/1974 |
| DE | 102012222010 | 6/2014 |
| DE | 10393433 | 10/2015 |

* cited by examiner

EXPANSION MACHINE HAVING A SHAFT SEALING RING AND A VALVE

BACKGROUND OF THE INVENTION

The invention relates to an expansion machine having a shaft sealing ring and a valve. The expansion machine can be used for example for the waste heat utilization of an internal combustion engine.

Expansion machines having a shaft sealing ring for sealing a working medium which flows in the expansion machine are known from the prior art, for example from unexamined German application DE 10 2012 222 010 A1. The expansion machine according to the invention comprises a gear with an output shaft and a shaft sealing ring which interacts with the output shaft. The expansion machine has an inflow region and an outflow region and during operation is exposed to a throughflow of a working medium, wherein compressed working medium flows into the inflow region and expanded working medium flows out of the outflow region. The shaft sealing ring separates a gear space or valve space filled with working medium from an ambient space or from an additional machine, for example from a generator.

Due to the principle of operation of a shaft sealing ring, it is always advantageous if a greater pressure prevails on one side of the shaft sealing ring than on the opposite side. This pressure difference presses a sealing lip of the shaft sealing ring onto the output shaft and therefore seals the two sides against each other. Specifically, the discharge of working medium from the expansion machine is prevented as a consequence.

At many operating points, the expansion machine is operated at positive pressure, that is to say the expanded working medium has a pressure which lies above atmospheric pressure. The sealing lip is customarily then arranged in relation to the output shaft in such a way that a positive pressure in the expansion machine in relation to the ambient space, which is under atmospheric pressure, is reliably sealed.

If the expansion machine should now to be operated at negative pressure with this shaft sealing ring arranged in such a way that the expanded working medium would have a lower pressure compared with atmospheric pressure, then the higher pressure level of the ambient space would lift the sealing lip from the output shaft, and the sealing effect of the shaft sealing ring would be lost. Therefore, leakage of working medium into the ambient space would occur.

SUMMARY OF THE INVENTION

The expansion machine according to the invention, having a shaft sealing ring and a valve, in contrast has the advantage that it can be operated both in positive pressure mode and in negative pressure mode without leakage and the shaft sealing ring can achieve a good sealing effect during all operating states. The expansion machine according to the invention therefore has a significantly larger range of operating states in which it can be used without leakage.

To this end, the expansion machine according to the invention comprises an output shaft and a shaft sealing ring which interacts with the output shaft. The expansion machine has an inflow region and an outflow region. During operation, the expansion machine is exposed to a throughflow of a working medium, wherein during operation of the expansion machine compressed working medium flows in the inflow region and expanded working medium flows out of the outflow region. The shaft sealing ring separates a valve space filled with working medium from an ambient space. A valve is arranged in the expansion machine, and the pressure in the valve space can be controlled by means of the valve.

Consequently, the pressure which acts upon the shaft sealing ring on the side of the expansion machine can be controlled. In this way, it can be ensured that the pressure on the shaft sealing ring on the side toward the expansion machine is always at least at the same value as on the side toward the environment or toward the ambient space. The sealing function of the shaft sealing ring is therefore ensured during all operating states of the expansion machine, even if this is operated at negative pressure. There is no occurrence of leakage of the working medium into the ambient space.

In an advantageous development, the expansion machine comprises a casing, wherein the valve is arranged in the casing. As a result, the valve does not require a separate casing but can be arranged in an inexpensive and installation space-saving manner in the casing of the expansion machine.

In an advantageous development, the inflow region is hydraulically connected to the valve space by means of a throttle. As a result of the connection of the valve space to the inflow region, the valve space can be controlled by means of the valve at the pressure level of the inflow region, wherein this pressure level is higher than the pressure level of the ambient space. Consequently, a good sealing effect of the shaft sealing ring is achieved. With the valve open, the throttle leads to the valve space not being raised to the pressure level of the inflow region, which is not even required for the valve space in this operating state.

In an alternative embodiment, the valve space is not connected to the inflow region but to a region which lies between inflow region and outflow region. As a result, with the valve closed a lower pressure is established in the valve space than the pressure of the inflow region. The load of the shaft sealing ring is reduced as a result and its service life is increased accordingly.

In an advantageous development, the valve comprises an inlet passage, an outlet passage and a closing body. The closing body is preferably of spherical design. The closing body interacts with a valve seat. The inlet passage opens into the valve space or leads out of this. The closing body, when being brought into contact with the valve seat, closes a hydraulic connection from the inlet passage to the outlet passage, and it opens the hydraulic connection when being lifted from the valve seat. As a result of the opening and closing of the hydraulic connection, the pressure in the valve space is controlled in a simple manner.

The outlet passage is advantageously at least indirectly hydraulically connected to the outflow region. As a result, the pressure in the valve space with the valve open is controlled at the pressure level of the outflow region which as a rule is the lowest pressure level inside the expansion machine. Consequently, the load of the shaft sealing ring with the valve open is minimized.

In an advantageous development of the expansion machine, the valve comprises a control space and a control passage which opens into the control space. Consequently, the valve can be pneumatically or hydraulically closed-loop controlled or even open-loop controlled.

In an advantageous development, the control passage is hydraulically connected to the ambient space or to atmosphere. This is especially advantageous when the pressure of the ambient space or the atmospheric pressure is applied on the side of the shaft sealing ring which faces away from the expansion machine because this pressure can then also be accurately used as a controlled variable for the valve. Furthermore, the controlling with atmospheric pressure or with the pressure of the ambient space is very inexpensive since a volume which has a corresponding pressure level is available anyway in the expansion machine or in its attached parts or even in the environment.

In an advantageous development, the valve comprises a membrane, and the control space is adjacent to the membrane. As a result, the control space can be partitioned off with media-tight effect, especially in relation to the inlet passage and to the outlet passage.

The membrane preferably consists of a metal, especially a thin metal, or an elastomer. Consequently, the membrane can be deformed in a comparatively easy manner and the hydraulic connection from inlet passage to outlet passage with the valve open correspondingly also has an adequately large cross section.

In an advantageous embodiment, the membrane on its side opposite the control space interacts at least indirectly with the closing body. Consequently, the geometries and materials of membrane and closing body can be selected in the best possible way with regard to their functions. The membrane is comparatively elastic and the closing body is wear-resistant and comparatively rigid.

In a continuation, the membrane, with interposition of an auxiliary piston, interacts with the closing body, wherein the auxiliary piston is preferably guided in a longitudinally movable manner in a guide sleeve. The auxiliary piston on the one hand consequently has the function which executes the longitudinal movement with as little friction as possible during opening and closing of the valve, for example in interaction with the guide sleeve. On the other hand, the transfer of force between auxiliary piston and closing body can be designed so that during the closing of the valve the closing body is centered very easily in the valve seat, for example as a result of convex designs of the contact surfaces of auxiliary piston and closing body.

In another advantageous embodiment of the expansion machine, an annular chamber is formed in the casing (26), at least partially radially encompassing the inlet passage. The outlet passage opens into the annular chamber, wherein the valve seat is arranged between the inlet passage and the annular chamber. As a result, the pressures from the outlet passage or from the annular chamber and from the inlet passage act upon the closing body in the same direction. If the outlet passage is under lower pressure than atmospheric pressure, then for this operating state the closing body is loaded with a comparatively low resulting hydraulic force by the working medium. The closing body is therefore pressed against the valve seat. Since the valve seat is formed between the annular chamber and the inlet passage, a throttling length for the operating state of the open valve can in this way also be established across the width of the valve seat.

The closing body is advantageously a membrane, preferably made from an elastomer or from a thin metal. The membrane can be constructed in a simple manner, for example in the form of a disk, and can therefore be installed in a cost-effective manner.

In an advantageous development, a control space, which opens into a control passage, is also formed here on the side of the membrane opposite the valve seat. The control space can therefore be connected via the control passage to a volume, for example to atmosphere or to the ambient space, which has a control pressure. The closing body or the membrane is then acted upon by this control pressure from one side and from the other side is partially acted upon by the pressure of the annular chamber or of the outflow region and partially by the pressure of the inlet passage or of the valve space. As a result of the area ratios of the individual surfaces upon which the different pressures act, the opening and closing of the valve can therefore be controlled, for example as follows: If the pressure in the annular chamber drops below the pressure of the control space, the membrane is pressed into the valve seat and the pressure maintaining function for the valve space is therefore activated.

The control space is advantageously formed between the membrane and a cover. The cover preferably also clamps the membrane on its periphery, for example by it pressing the membrane against the casing of the valve or of the expansion machine. As a result, the membrane is fixed on the periphery inside the valve. The opening and closing of the valve is therefore carried out by a movement of the non-clamped surfaces of the membrane.

The control passage is preferably formed in the cover, wherein the control passage at its end opposite the control space is preferably hydraulically connected to the ambient space or to atmosphere. Consequently, the control passage can be inexpensively produced by means of a simple hole in the cover.

Specifically for the case in which the control space is connected to the ambient space, the control passage can alternatively also be guided in an installation spacing-saving manner through a common casing of expansion machine or valve and ambient space.

In preferred embodiments, the expansion machine according to the invention is arranged in a waste heat recovery system, especially of an internal combustion engine. The waste heat recovery system comprises, in the flow direction of the working medium, a pump, an evaporator, the expansion machine and a condenser. In an advantageous embodiment, the outlet passage is at least indirectly hydraulically connected to the condenser. The outflow region of the expansion machine is customarily hydraulically connected to the condenser and so has the same pressure as the condenser. The outlet passage is then advantageously connected to this pressure level which exists in any case. The waste heat recovery system is preferably not operated at a single operating point but at very different operating points since the internal combustion engine is also operated at different operating points. As a result, it is very favorable for the overall efficiency of the waste heat recovery system if the expansion machine can run both in positive pressure mode and in negative pressure mode. The expansion machine according to the invention is consequently particularly suitable for this.

DETAILED DESCRIPTION

Figure 1:
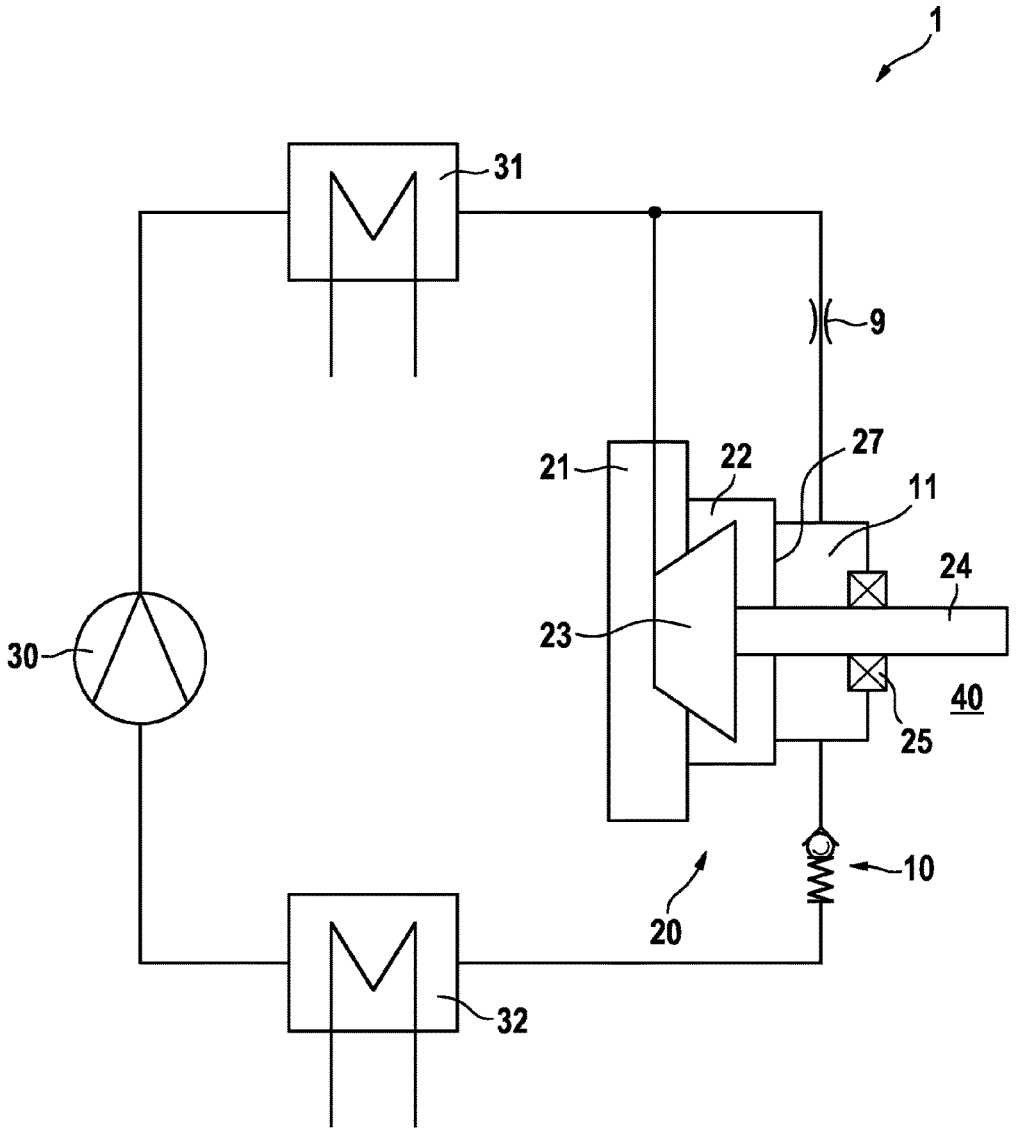
FIG. 1 schematically shows an expansion machine according to the invention inside a waste heat recovery system, wherein only the essential regions are shown.

FIG. 1 schematically shows an expansion machine 20 according to the invention inside a waste heat recovery system 1, wherein only the essential regions are shown. Arranged in the waste heat recovery system 1, in the flow direction of a working medium, are a pump 30, an evaporator 31, an expansion machine 20 and a condenser 32. The evaporator 31 is also connected to an exhaust gas pipe, which not shown, of an internal combustion engine, which is not shown.

Liquid working medium is compressed by the pump 30 and delivered to the evaporator 31 where it is evaporated by means of the thermal energy of the exhaust gas of the internal combustion engine. The evaporated working medium is then fed to the expansion machine 20 where it is expanded, releasing mechanical energy. The working medium is then liquefied again in the condenser 32.

The expansion machine 20 can in this case be for example a turbine, a piston expander or a scroll expander. In the exemplary embodiment of FIG. 1, the expansion machine 20 is a turbine with an impeller 23 and an output shaft 24.

The expansion machine 20 furthermore comprises according to the invention an inflow region 21, an outflow region 22, a shaft sealing ring 25, a valve 10, a valve space 11 and a partitioning wall 27. The compressed working medium flows through the inflow region 21 and the outflow region 22 and is expanded in the process. The mechanical energy which is released in the process is transmitted by means of the output shaft 24 to one or more users, which are not shown, for example to a turbocharger, to a gear or to a generator.

The inflow region 21 is at least indirectly hydraulically connected to the valve space 11 via a throttle 9. The valve 10 opens and closes a hydraulic connection from the valve space 11 to the outflow region 22 or to the condenser 32. The valve space 11 is sealed by means of the partitioning wall 27 in relation to the outflow region and sealed by means of the shaft sealing ring 25 in relation to an ambient space 40. The ambient space 40 can in this case be for example a gear space or even an atmospheric space.

The partitioning wall 27 is shown in FIG. 1 between the outflow region 22 and the valve space 11, but does not necessarily have to be arranged in this way. The intention is only to indicate that in the valve space 11 there is only a hydraulic inflow via the throttle 9 and a hydraulic outflow via the valve 10, and that the valve space 11 is otherwise isolated from the inflow region 21 and from the outflow region 22. Furthermore, the arrangement of the valve space 11 depends upon on which side the output shaft 24 is guided out of the expansion machine 20 since the shaft sealing ring 25 is customarily arranged at this point and also has to be arranged adjacent to the valve space 11 accordingly.

In an alternative embodiment, the valve 10 can for example also be arranged in the partitioning wall 27 or the partitioning wall 27 can be arranged between inflow region 21 and valve space 11 and the throttle 9 is then formed in the partitioning wall 27. Also important for the diverse embodiments are in this case the pressures in inflow region 21, outflow region 22, valve space 11 and ambient space 40. This is dealt with in more detail later, however.

Figure 2:
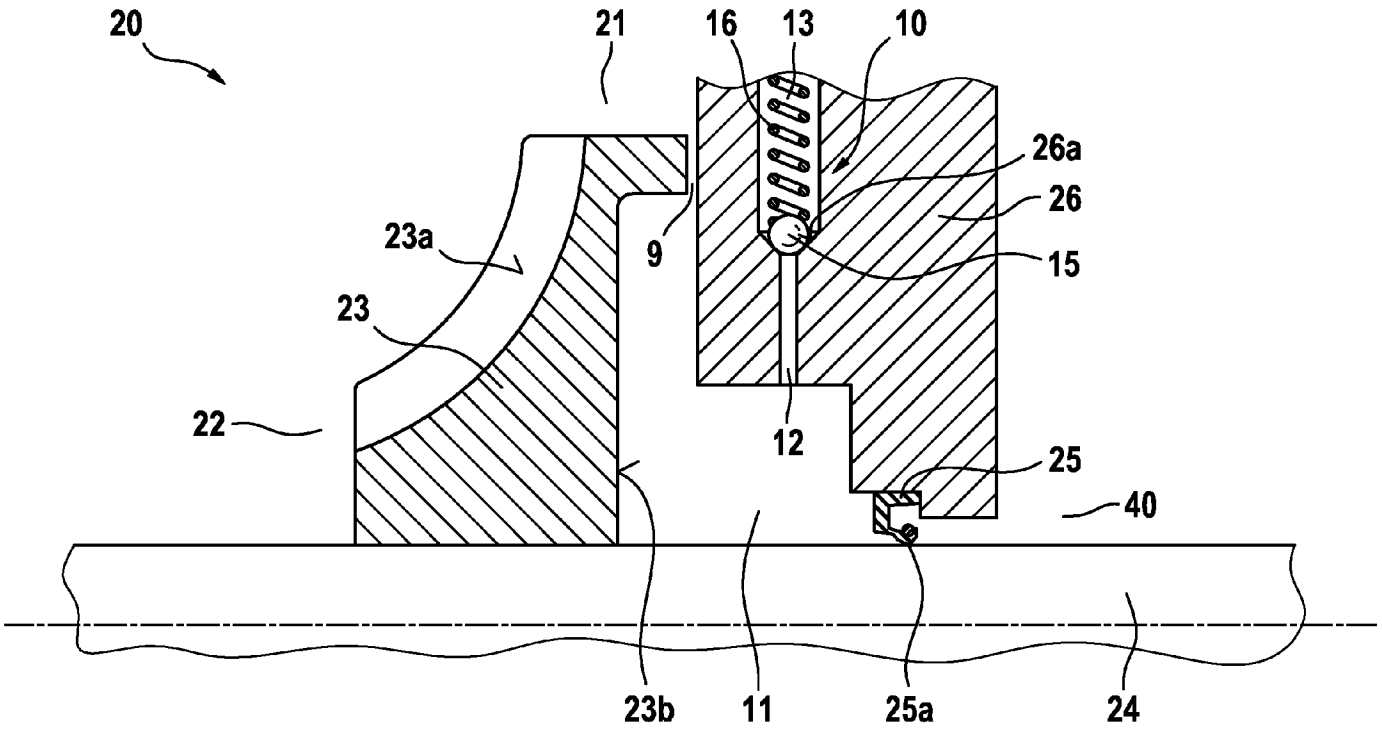
FIG. 2 schematically shows an exemplary embodiment of the expansion machine, wherein only the essential regions are shown.

FIG. 2 schematically shows an exemplary embodiment of the expansion machine 20, wherein only the essential regions are shown. The expansion machine 20 is constructed as a radial turbine and comprises a casing 26, in which the valve 10 is arranged. The impeller 23, the output shaft 24 which is fixedly connected to this, and the shaft sealing ring 25 are also advantageously arranged in the casing 26. Furthermore, the inflow region 21, the outflow region 22 and the valve space 11 are formed in the casing 26. In the exemplary embodiment of FIG. 2, the partitioning wall 27, which is schematically shown in FIG. 1, can therefore be considered to be a combination of impeller 23 and output shaft 24.

The valve space 11 is advantageously formed on a rear side 23*b* of the impeller 23, that is to say on the side which faces away from the actual flow path of the working medium through the impeller 23. As a result, a positive pressure which prevails in the valve space 11 in relation to the outflow region 22 can bring about an at least partial balance of the pressures or forces in the axial direction which act upon the impeller 23. The shaft sealing ring 25 seals the valve space 11 in relation to the ambient space 40 by a sealing lip 25*a*, which is arranged on the shaft sealing ring 25, interacting with the output shaft 24.

The transition from the inflow region 21 to the outflow region 22 is not a boundary which is clear to define. The working medium is expanded on the front side 23*a* of the impeller 23 when the impeller is exposed to a throughflow of the working medium, wherein as a result of the expansion a pressure drop is created across the impeller 23 or across the front side 23*a* so that in this case the inflow region 21 is not clearly to be separated from the outflow region 22 but forms a type of mixing region in which the pressure of an inlet pressure upstream of the expansion machine 20 drops to an outlet pressure downstream of the expansion machine 20.

The valve space 11 is hydraulically connected to the inflow region 21 via the throttle 9. In alternative embodiments, the valve space 11 can also be connected to the mixing region, however. Attention is to be given to the fact, however, that at the throttle 9 the region opposite the valve space 11—regardless of whether it is inflow region 21 or mixing region—has a greater pressure than the ambient space 40 during operation of the expansion machine 20.

The valve 10 comprises an inlet passage 12, an outlet passage 13, a spherical closing body 15 and a closing spring 16. The inlet passage 12 opens into the valve space 11. The outlet passage 13 advantageously opens into a region which has a lower pressure than the valve space 11, for example into the outflow region 22. The closing body 15 interacts with a valve seat 26*a* which is formed on the casing 26 and consequently opens and closes a hydraulic connection from the inlet passage 12 to the outlet passage 13. The closing spring 16 presses the closing body 15 against the valve seat 26*a*. By means of the closing spring 16, a minimum pressure can therefore be established in the valve space 11.

Figure 3A:
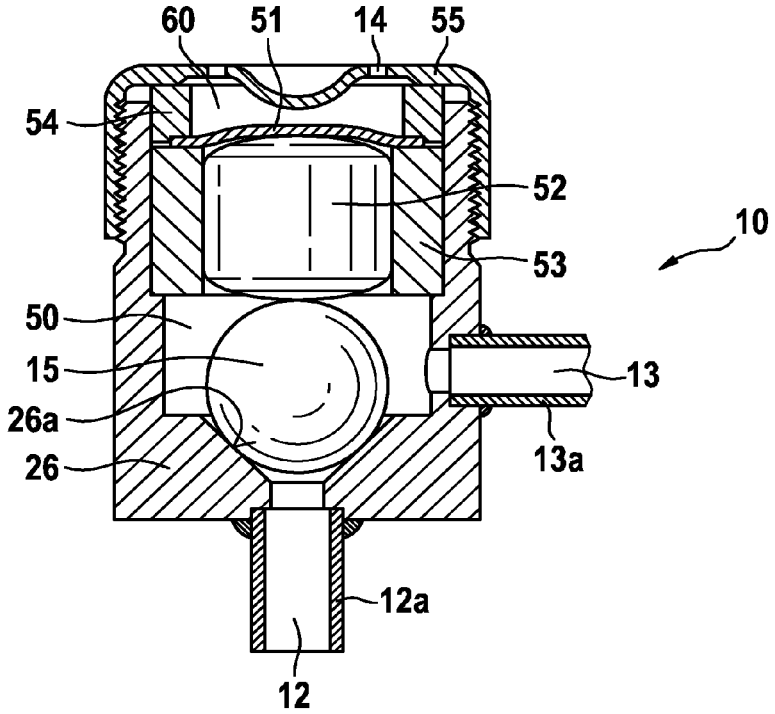
FIG. 3*a* shows an exemplary embodiment of a valve of the expansion machine with the valve in the closed position.
Figure 3B:
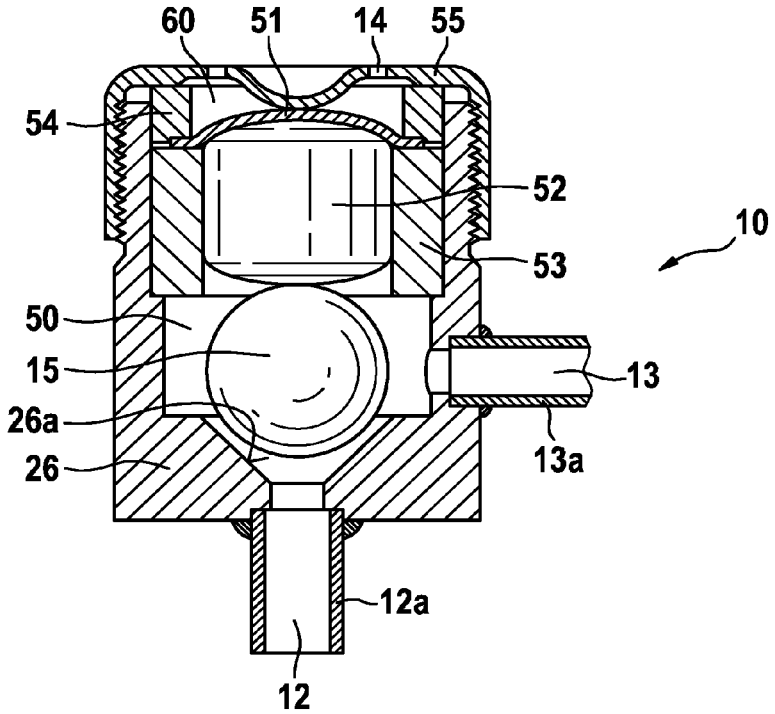
FIG. 3*b* shows an exemplary embodiment of a valve of the expansion machine with the valve in the open position.

FIG. 3 shows an exemplary embodiment of the valve 10, wherein FIG. 3*a* shows the valve 10 in the closed position and FIG. 3*b* shows the valve 10 in the open position. The valve 10 is arranged in the casing 26 of the expansion machine 20. Alternatively, the valve 10 can also be arranged in any other casing, however.

The inlet passage 12 is formed in an inlet pipe 12*a* and the outlet passage 13 is formed in an outlet pipe 13*a*. The inlet pipe 12*a* and the outlet pipe 13*a* are pressed or screwed into the casing 26. Both the inlet passage 12 and the outlet passage 13 open into an inner space 50 which is formed in the casing 26. Arranged on the casing 26 inside the inner space 50, between inlet pipe 12*a* and outlet pipe 13*a*, is the valve seat 26*a* with which interacts the closing body 15 which is arranged inside the inner space 50. In the closed position of the valve 10, the closing body 15, with interposition of an auxiliary piston 52, is pressed against the valve seat 26*a* by a membrane 51 which in this exemplary embodiment acts like a leaf spring (FIG. 3*a*). In the open position of the valve 10, the closing body 15 is lifted from the valve seat 26*a* and therefore opens the hydraulic connection from the inlet passage 12 o the outlet passage 13 (FIG. 3*b*).

The auxiliary piston 52 is guided in a longitudinally movable manner in the casing 26, that is to say in the opening and closing directions of the closing body 15, by a guide sleeve 53 which is fixedly connected to the casing 26. The membrane 51 is fixedly connected on its edges by a clamping piece 54 to the guide sleeve 53 and is therefore also indirectly connected to the casing 26. A cover 55 is screwed to the casing 26 and as a result presses the clamping piece 54, with interposition of the edge of the membrane 51, against the guide sleeve 53. The membrane 51 is therefore clamped on its periphery to the casing 26. The contact between guide sleeve 53 and closing body 15 can for example be of convex design in order to optimize the automatic centering of the closing body 15 in the valve seat 26*a*.

A control space 60 is formed between membrane 51, clamping piece 54 and cover 55. The membrane 51 in this case seals the control space 60 against the inner space 50. A control passage 14 opens into the control space 60. The control passage 14 can be a hole in the cover 55, as in the exemplary embodiment of FIG. 3. The control passage 14, however, can for example also be formed in a control pipe which is screwed or pressed into the cover 55 or into the casing 26.

In alternative embodiments, the guide sleeve 53 and/or the clamping piece 54 can even be omitted. The corresponding functions—clamping of the membrane 51 and guiding of the auxiliary piston 52—are then for example integrated into the two components comprising casing 26 and cover 55. Furthermore, it is also possible to omit the auxiliary piston 52 and to allow the membrane 51 to act directly upon the closing body 15.

Preferably, the control passage 14 is hydraulically connected to atmosphere, the inlet passage 12 is hydraulically connected to the valve space 11 and the outlet passage 13 is hydraulically connected to the outflow region 22

Figure 4:
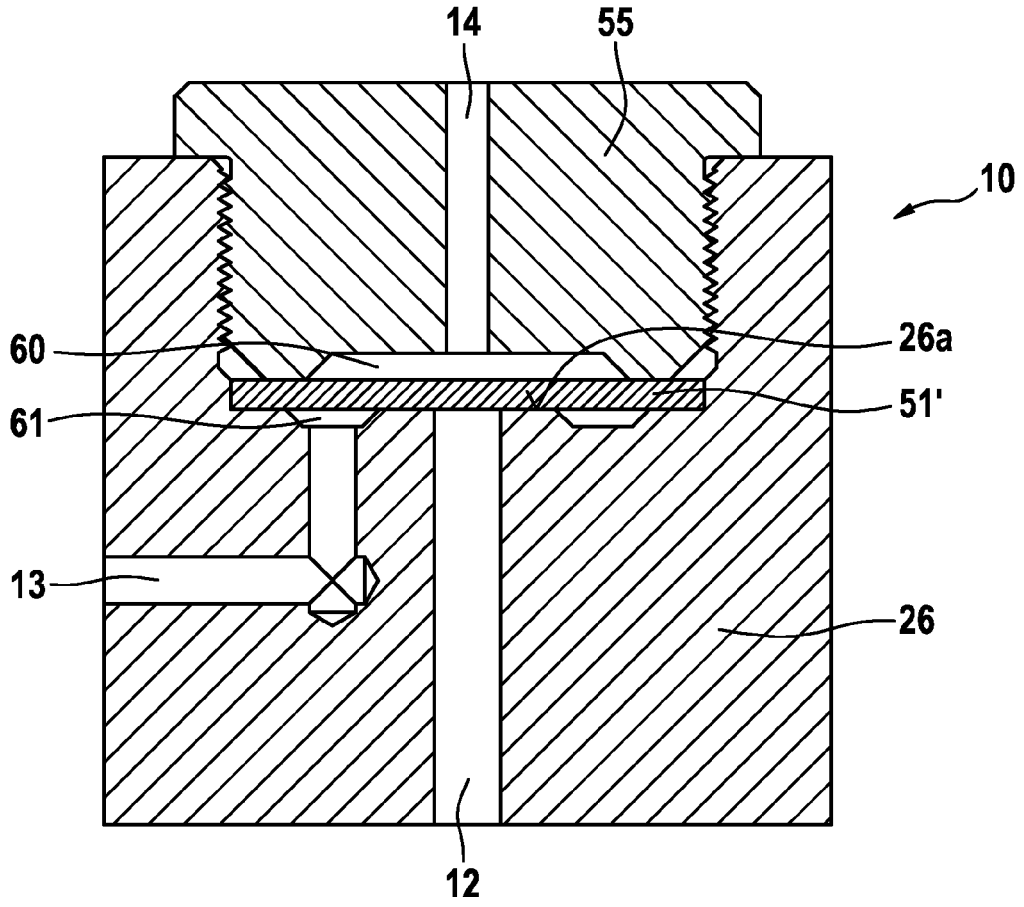
FIG. 4 shows a further exemplary embodiment of the valve, wherein only the essential regions are shown.

FIG. 4 shows a further exemplary embodiment of the valve 10, wherein only the essential regions are shown. The valve 10 is arranged in the casing 26 of the expansion machine 20. Alternatively, the valve 10 can also be arranged in any other casing, however.

The inlet passage 12 and the outlet passage 13 are arranged in the casing 26. A membrane 51' is clamped between the casing 26 and the cover 55, wherein in this exemplary embodiment the membrane 51' has the function of the closing body. The cover 55 is screwed to the casing 26. The control passage 14 is formed in the cover 55. Formed between the cover 55 and the membrane 51' is the control space 60 into which opens the control passage 14.

On the side opposite the control space 60, the membrane 51', in the closed position of the valve 10, seals the inlet passage 12 by it interacting with the valve seat 26*a* which is formed on the casing 26. An annular chamber 61, into which the outlet passage 13 opens out, is formed in the casing 26, at least partially radially encompassing the inlet passage 12. In the closed position of the valve 10, the hydraulic connection from the inlet passage 12 to the annular chamber 61 is closed by abutment of the membrane 51' against the valve seat 26*a*. In the open position of the valve 10, the membrane 51' is lifted from the valve seat 26*a* and as a result opens the hydraulic connection from the inlet passage 12 to the annular chamber 61.

The principle of operation of the expansion machine 20 according to the invention is as follows:

The shaft sealing ring 25 seals the valve space 11, filled with working medium, in relation to the ambient space 40. The ambient space 40 can in this case be filled for example with air or with gear oil. In the exemplary embodiment of FIG. 2, the sealing lip 25*a* of the shaft sealing ring 25 is curved in the direction of the valve space 11, therefore toward the expansion machine. This is a typical arrangement of the sealing lip 25*a* for an expansion machine 20. That is to say, a greater pressure has to prevail in the valve space 11 than in the ambient space 40 in order to press the sealing lip 25*a* onto the output shaft 24 and to therefore achieve a sealing effect. The valve 10 is preferably arranged in expansion machines 20 which are operated at least occasionally at negative pressure. That is to say, the outflow region 22 of these expansion machines 20 has at least occasionally a lower pressure than atmospheric pressure.

The pressure level of the valve space 11 customarily lies at the low pressure level of the expansion machine 20, that is to say at the pressure level of the outflow region 22. If the valve space 11 is therefore hydraulically connected, or able to be hydraulically connected, to the outflow region 22, then by means of a device it has to be maintained at a pressure level which lies above that of the ambient space 40 in order to obtain the sealing effect by means of the shaft sealing ring 25. Along with this, the valve space 11 also has to be maintained above the pressure level of the outflow region 22 if this drops below the pressure level of the ambient space 40.

The valve 10 fulfills this object: With the valve 10 open, the hydraulic connection from the valve space 11 to the outflow region 22 is opened, the valve space 11 will therefore adopt the pressure level of the outflow region 22. Providing the outflow region 22 has a higher pressure than, or a pressure of equal value to, the ambient space 40, a sealing effect of the shaft sealing ring 25 is consequently therefore still achieved. If the pressure in the outflow region 22 now drops below the pressure of the ambient space 40, for example because the expansion machine 20 is operated at negative pressure, then the valve 10 is closed, and along with it, the hydraulic connection from the valve space 11 to the outflow region 22.

The valve space 11 is hydraulically permanently connected via the throttle 9 to a region the pressure level of which during operation of the expansion machine 20 lies above the pressure level of the ambient space 40, for example to the inflow region 21, as shown in the exemplary embodiments of FIGS. 1 and 2. With the valve 10 closed, the pressure in the valve space 11 therefore rises to the pressure level of this region. If the valve is opened, then a pressure drop occurs at the throttle 9.

The controlling of the opening and closing movements of the valve 10, so that during operation of the expansion machine 20 a positive pressure still exists in the valve space 11 in relation to the ambient space 40, even with minimal pressure of the outlet passage 13 or of the outflow region 22 or of the condenser 32, is carried out in different ways in the various embodiments:

In the embodiment of FIG. 2, the controlling is carried out by setting the closing spring 16 in relation to the seat diameter of the valve seat 26*a*. For example: if the condenser 32 is operated at pK=0.5 bar absolute and the ambient space 40 has atmospheric pressure, that is to say pU=1.0 bar, then the closing spring 16 needs to have a pressure maintaining function of pV =0.7 bar (in this case the hydraulic forces have to be taken into consideration on account of the seat diameter of valve seat 26*a*) so that on the shaft sealing ring 25 a pressure difference $\Delta p=0.2$ bar prevails for sealing the valve space 11 against the ambient space 40 ($\Delta p=pK+pV-pU$).

In the embodiment of FIG. 3, the controlling is carried out by the diameters of the auxiliary piston 52 and of the valve seat 26*a*. In variants, in which the auxiliary piston 52 is omitted, the relevant diameter of the membrane 51, on which bears the pressure of the inner space 50, is correspondingly used for controlling.

In the embodiment of FIG. 4, the controlling is carried out by the diameters of valve seat 26*a*, annular chamber 61 and control space 60. In this case, the diameters of annular chamber 61 and control space 60 are preferably approximately of equal size. The diameter of the control space 60, however, has to be larger than the diameter of the valve seat 26*a*.

The rigidity of the membrane 51, 51' naturally has an effect upon the opening and closing behavior of the valve 10 in the embodiments of FIGS. 3 and 4. Ideally, the membrane 51, 51' is of soft design, for example as an elastomer membrane or even as a thin metal membrane in order to be able to design the opening and closing behavior of the valve 10 via the aforesaid diameters in a simple and robust manner.

The invention claimed is:

1. An expansion machine (20) having an output shaft (24) and a shaft sealing ring (25) which interacts with the output shaft, wherein the expansion machine (20) has an inflow region (21) and an outflow region (22), wherein the expansion machine is configured such that compressed working medium flows into the inflow region (21) and expanded working medium flows out of the outflow region (22), and wherein the shaft sealing ring (25) separates a valve space (11) filled with working medium from an ambient space (40), characterized in that a valve (10) is arranged in the expansion machine (20) and the pressure in the valve space (11) is controlled by the valve (10).

2. The expansion machine (20) as claimed in claim 1, characterized in that the expansion machine (20) comprises a casing (26) and the valve (10) is arranged in the casing (26).

3. The expansion machine (20) as claimed in claim 1, characterized in that the inflow region (21) is hydraulically connected to the valve space (11) by a throttle (9).

4. The expansion machine (20) as claimed in claim 1, characterized in that the valve (10) comprises an inlet passage (12), an outlet passage (13), and a closing body (15), wherein the closing body (15) interacts with a valve seat (26*a*), wherein the inlet passage (12) opens into the valve space (11), and wherein the closing body (15) when being brought into contact with the valve seat (26*a*) closes a hydraulic connection from the inlet passage (12) to the outlet passage (13) and when being lifted from the valve seat (26*a*) opens the hydraulic connection.

5. The expansion machine (20) as claimed in claim 4, characterized in that the outlet passage (13) is at least indirectly hydraulically connected to the outflow region (22).

6. The expansion machine (20) as claimed in claim 4, characterized in that the valve (10) comprises a control space (60) and a control passage (14) which opens into the control space (60).

7. The expansion machine (20) as claimed in claim 6, characterized in that the control passage (14) is hydraulically connected to the ambient space (40) or to atmosphere.

8. The expansion machine (20) as claimed in claim 6 wherein the valve (10) comprises a membrane (51), and wherein the control space (60) is adjacent to the membrane (51).

9. The expansion machine (20) as claimed in claim 8, characterized in that the membrane (51) on a side opposite the control space (60) at least indirectly interacts with the closing body (15).

10. The expansion machine (20) as claimed in claim 9, characterized in that the membrane (51), with interposition of an auxiliary piston (52), interacts with the closing body (15).

11. The expansion machine (20) as claimed in claim 9, characterized in that the membrane (51), with interposition of an auxiliary piston (52), interacts with the closing body (15), wherein the auxiliary piston (52) is guided in a longitudinally movable manner in a guide sleeve (53).

12. The expansion machine (20) as claimed in claim 6 wherein the valve (10) comprises a membrane (51), and wherein the control space (60) is adjacent to the membrane (51), wherein the membrane (51) consists of a metal or an elastomer.

13. The expansion machine (20) as claimed in claim 4, characterized in that the closing body (15) is a membrane (51').

14. The expansion machine (20) as claimed in claim 13, characterized in that an annular chamber (61) is formed in the casing (26), at least partially radially encompassing the inlet passage (12), and the outlet passage (13) opens into the annular chamber (61), wherein the valve seat (26*a*) is arranged between the inlet passage (12) and the annular chamber (61).

15. The expansion machine (20) as claimed in claim 13, characterized in that a control space (60), which opens into a control passage (14), is formed on the side of the membrane (51') opposite the valve seat (26*a*).

16. The expansion machine (20) as claimed in claim 15, characterized in that the control space (60) is formed between the membrane (51') and a cover (55), wherein the cover (55) clamps the membrane (51') on its periphery and wherein the control passage (14) is formed in the cover (55).

17. The expansion machine (20) as claimed in claim 15, characterized in that the control space (60) is formed between the membrane (51') and a cover (55), wherein the cover (55) clamps the membrane (51') on its periphery and wherein the control passage (14) is formed in the cover (55), and wherein the control passage (14), at an end opposite the control space (60), is hydraulically connected to the ambient space (40) or to atmosphere.

18. A waste heat recovery system (1) having an expansion machine (20), as claimed in claim 4, a condenser (32), a pump (30) and an evaporator (31).

19. The expansion machine (20) as claimed in claim 4, characterized in that the closing body (15) is a membrane (51') made from a metal or from an elastomer.

20. The expansion machine (20) as claimed in claim 1, characterized in that the valve (10) comprises an inlet passage (12), an outlet passage (13), and a spherical closing body (15), wherein the closing body (15) interacts with a valve seat (26*a*), wherein the inlet passage (12) opens into the valve space (11), and wherein the closing body (15) when being brought into contact with the valve seat (26*a*) closes a hydraulic connection from the inlet passage (12) to the outlet passage (13) and when being lifted from the valve seat (26*a*) opens the hydraulic connection.

* * * * *